US008807005B2

(12) United States Patent
Moss et al.

(10) Patent No.: US 8,807,005 B2
(45) Date of Patent: Aug. 19, 2014

(54) FIREARM SUPPRESSOR HAVING ENHANCED THERMAL MANAGEMENT FOR RAPID HEAT DISSIPATION

(71) Applicant: Lawrence Livermore National Security, LLC, Livermore, CA (US)

(72) Inventors: William C. Moss, San Mateo, CA (US); Andrew T. Anderson, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 13/738,608

(22) Filed: Jan. 10, 2013

(65) Prior Publication Data

US 2014/0076136 A1 Mar. 20, 2014

Related U.S. Application Data

(60) Provisional application No. 61/682,152, filed on Aug. 10, 2012.

(51) Int. Cl.
*F41A 21/30* (2006.01)
*F41A 21/44* (2006.01)
*F41A 21/34* (2006.01)

(52) U.S. Cl.
USPC ..... 89/14.1; 89/14.4; 181/223

(58) Field of Classification Search
USPC ..... 89/14.1, 14.2, 14.3, 14.4; 42/1.06; 181/223; D22/108
See application file for complete search history.

(56) References Cited

U.S. PATENT DOCUMENTS

| | | | | | |
|---|---|---|---|---|---|
| 743,042 | A | * | 11/1903 | Simpson | 89/14.3 |
| 916,885 | A | | 3/1909 | Maxim | |
| 1,413,903 | A | * | 4/1922 | Czegka | 89/14.1 |
| 2,112,660 | A | * | 3/1938 | Hudson | 89/149 |
| 2,765,706 | A | * | 10/1956 | Strohl | 89/14.3 |
| 2,872,848 | A | * | 2/1959 | Schuessler | 89/14.3 |
| 3,707,899 | A | * | 1/1973 | Perrine | 89/14.3 |
| 6,298,764 | B1 | * | 10/2001 | Sherman et al. | 89/14.2 |
| 8,196,701 | B1 | | 6/2012 | Oliver | |
| 8,286,750 | B1 | | 10/2012 | Oliver | |
| 2003/0145718 | A1 | * | 8/2003 | Hausken et al. | 89/14.4 |
| 2004/0173403 | A1 | * | 9/2004 | Shafer | 181/223 |
| 2005/0262997 | A1 | * | 12/2005 | Brixius | 89/14.1 |

OTHER PUBLICATIONS

Skochko, L. W. et. al. "Silencers, principles and evaluations", Report # R-1896, Dept. of the Army, Frankford Arsenal, Philadelphia, PA (1968), pp. 2-7, 119, 122-123, and 150.

* cited by examiner

*Primary Examiner* — Bret Hayes
(74) *Attorney, Agent, or Firm* — Harness, Dickey & Pierce, PLC

(57) ABSTRACT

A suppressor is disclosed for use with a weapon having a barrel through which a bullet is fired. The suppressor has an inner portion having a bore extending coaxially therethrough. The inner portion is adapted to be secured to a distal end of the barrel. A plurality of axial flow segments project radially from the inner portion and form axial flow paths through which expanding propellant gasses discharged from the barrel flow through. The axial flow segments have radially extending wall portions that define sections which may be filled with thermally conductive material, which in one example is a thermally conductive foam. The conductive foam helps to dissipate heat deposited within the suppressor during firing of the weapon.

20 Claims, 5 Drawing Sheets

FIREARM SUPPRESSOR HAVING ENHANCED THERMAL MANAGEMENT FOR RAPID HEAT DISSIPATION

CROSS-REFERENCE TO RELATED APPLICATIONS

This application claims the benefit of U.S. Provisional Application No. 61/682,152 filed on Aug. 10, 2012. The disclosure of the above application is incorporated herein by reference.

STATEMENT OF GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

FIELD

The present disclosure relates to noise and flash suppressors, and more particularly to a noise and flash suppressor having significantly enhanced heat dissipation that is well adapted for use with weapons capable of firing rapid bursts of ammunition, and particularly with machine guns, fully automatic rifles and fully automatic handguns.

BACKGROUND

The statements in this section merely provide background information related to the present disclosure and may not constitute prior art.

Weapons such as firearms often produce noise and flash. A suppressor is a device that attaches to the muzzle of the weapon and reduces noise and/or flash. For more than 100 years suppressors have been designed typically for single shot or low rate-of-fire weapons, for example semi-automatic rifles and handguns. Conventional suppressors perform acoustic suppression using internal baffles and chambers that both trap and delay the hot, combusted, expanding propellant gases exiting the barrel of the weapon from entering the ambient environment, as well as reduce the temperature of the expanding propellant gasses before they exit the suppressor. Such previous suppressor designs generally operate by expanding and cooling the hot expanding propellant gasses in the internal chambers of the suppressor, then delaying the release of the gasses, which transfers additional heat to the suppressor. The additional time that the expanding propellant gasses spend in the suppressor before being discharged to the ambient atmosphere results in a reduced acoustic signature.

Conventional suppressor designs, however, are not well suited for weapons which can fire rapid bursts of ammunition, and especially machine guns which are capable of firing bursts at rates of hundreds of rounds per minute. Such bursts of fire can produce unacceptably long dwell times for the expanding propellant gasses that are contained inside the suppressor. The long dwell times for the propellant gases can cause overheating and failure, and potentially even melting, of the internal components of a conventional noise/flash suppressor. In particular, when a conventional suppressor experiences rapid bursts of fire, the heat deposited deep within it, near its bore line, can quickly reach temperatures that cause damage to the suppressor. A conventional suppressor is shown in FIG. 1 that illustrates the multiple baffles near the bore axis of the suppressor that will be subjected to significant heat when firing rapid bursts of ammunition from a weapon, for example from a machine gun.

Accordingly, there remains a need to provide a suppressor which is more efficient at rapidly dissipating the significant heat that is built up deep within its interior areas when the suppressor is used with a weapon firing high rate-of-fire bursts of ammunition.

SUMMARY

In one aspect the present disclosure relates to a suppressor for a weapon, where the weapon has a barrel. The suppressor may comprise an inner portion having a bore extending coaxially there through. The inner portion is adapted to be secured to a distal end of the barrel. A plurality of axial flow segments may project radially from the inner portion and may be in flow communication with the bore, and thus may form axial flow paths for expanding propellant gasses discharged from the barrel to flow through. The axial flow segments may further have radially extending wall portions that help to dissipate heat deposited in the suppressor during firing of the weapon.

In another aspect the present disclosure relates to a suppressor for a weapon, where the weapon has a barrel. The suppressor may have an inner portion having a bore extending coaxially there through. The inner portion is adapted to be secured to a distal end of the barrel. A plurality of axial flow segments may be included which project radially outwardly from the inner portion and which are formed in part by radially extending wall portions. The axial flow segments form independent axial flow paths which are in flow communication with the bore and arranged circumferentially around the bore. The independent axial flow paths expand propellant gasses discharged from the barrel that flow into the bore of the suppressor. The suppressor may also include a plurality of air gap sections, with each air gap section being disposed between adjacent ones of the axial flow segments.

In still another aspect the present disclosure relates to a method for suppressing noise and/or flash emanating from a barrel of a weapon when a bullet is fired from the barrel of the weapon. The method may comprise securing an inner portion of a suppressor to a distal end of the barrel to receive the bullet and expanding propellant gasses discharged from the distal end of the barrel when the weapon is fired. A bore within the inner portion of the suppressor may be used to receive and channel the expanding propellant gasses through the suppressor. A plurality of independent axial flow segments of the suppressor, each being in flow communication with the bore, may be used to receive portions of the expanding propellant gasses as the expanding propellant gasses flow through the bore, and to delay the exit of the portions of the expanding propellant flow from the suppressor. Radially extending wall portions may be used that project from the inner portion of the suppressor to help separate the axial flow segments and to conductively channel heat built up within the suppressor at the inner portion radially outwardly to an ambient environment.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
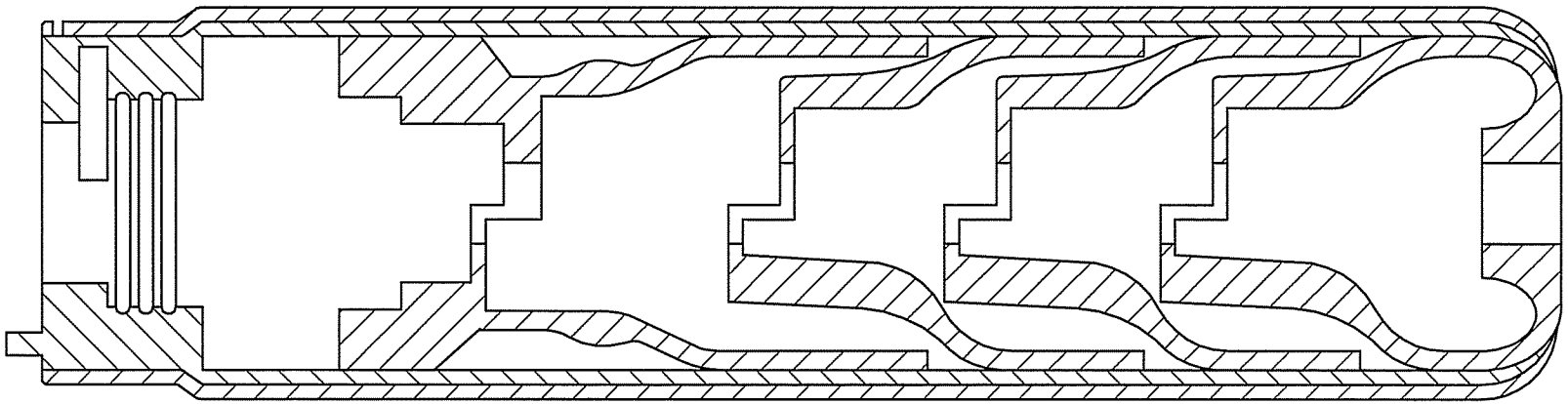
Figure 1 PRIOR ART
FIG. 1 is a cross sectional side view of a prior art suppressor.

The following description is merely exemplary in nature and is not intended to limit the present disclosure, application, or uses. It should be understood that throughout the drawings, corresponding reference numerals indicate like or corresponding parts and features.

Figure 2:
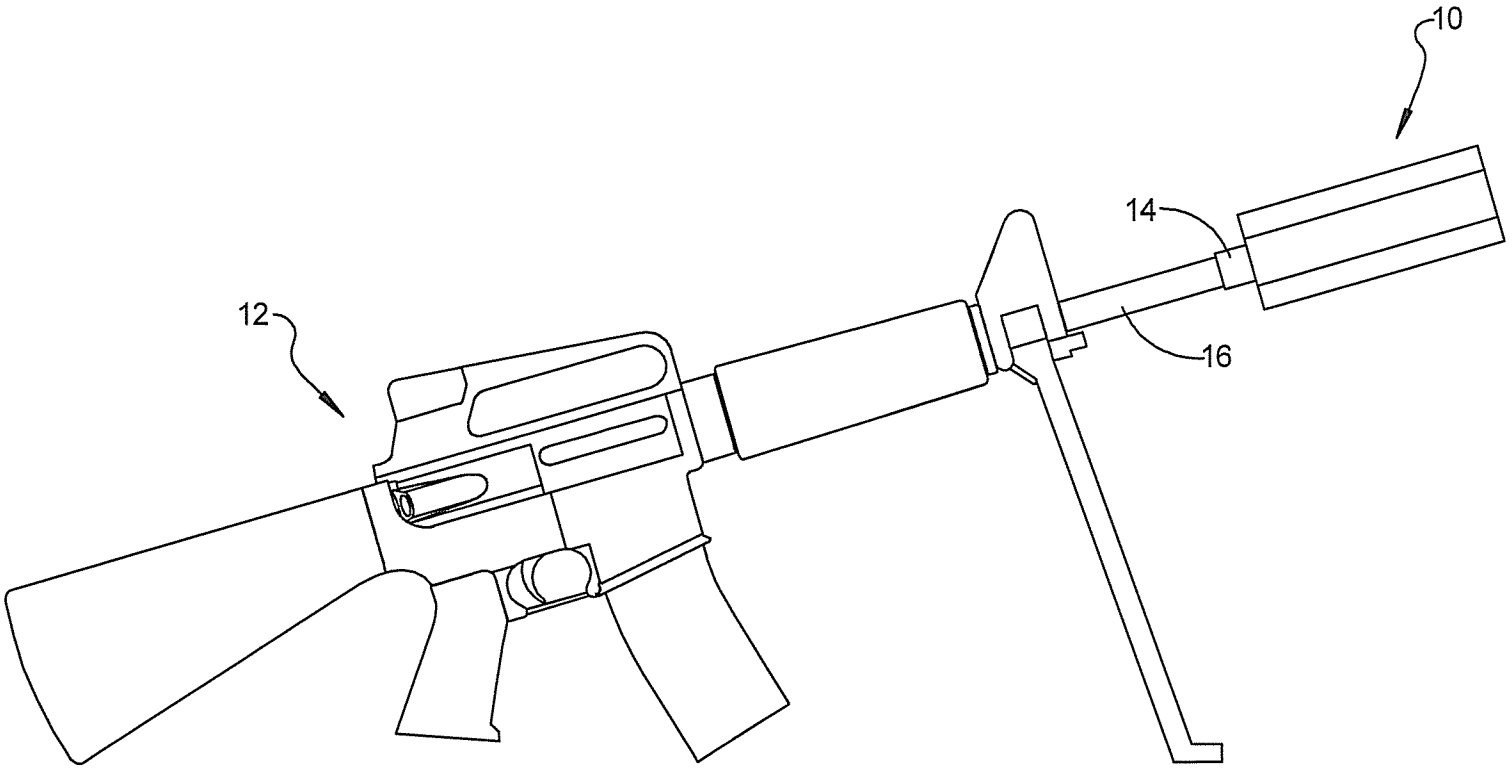
FIG. 2 is a perspective view of a suppressor in accordance with one embodiment of the present disclosure attached to the distal (muzzle) end of a barrel of a weapon, and wherein the weapon is shown as a machine gun.

Referring to FIG. 2 a suppressor 10 is shown in accordance with one embodiment of the present disclosure, for reducing noise and/or flash. The suppressor 10 is well adapted for use with a weapon 12 such as a fully automatic firearm, for example a machine gun, which is typically used to fire rapid bursts of ammunition at dozens or even hundreds of rounds per minute. The suppressor 10 may be attached to a distal (i.e., muzzle) end 14 of a barrel 16 via a conventional threaded attachment or any other suitable means of attachment.

Figure 3:
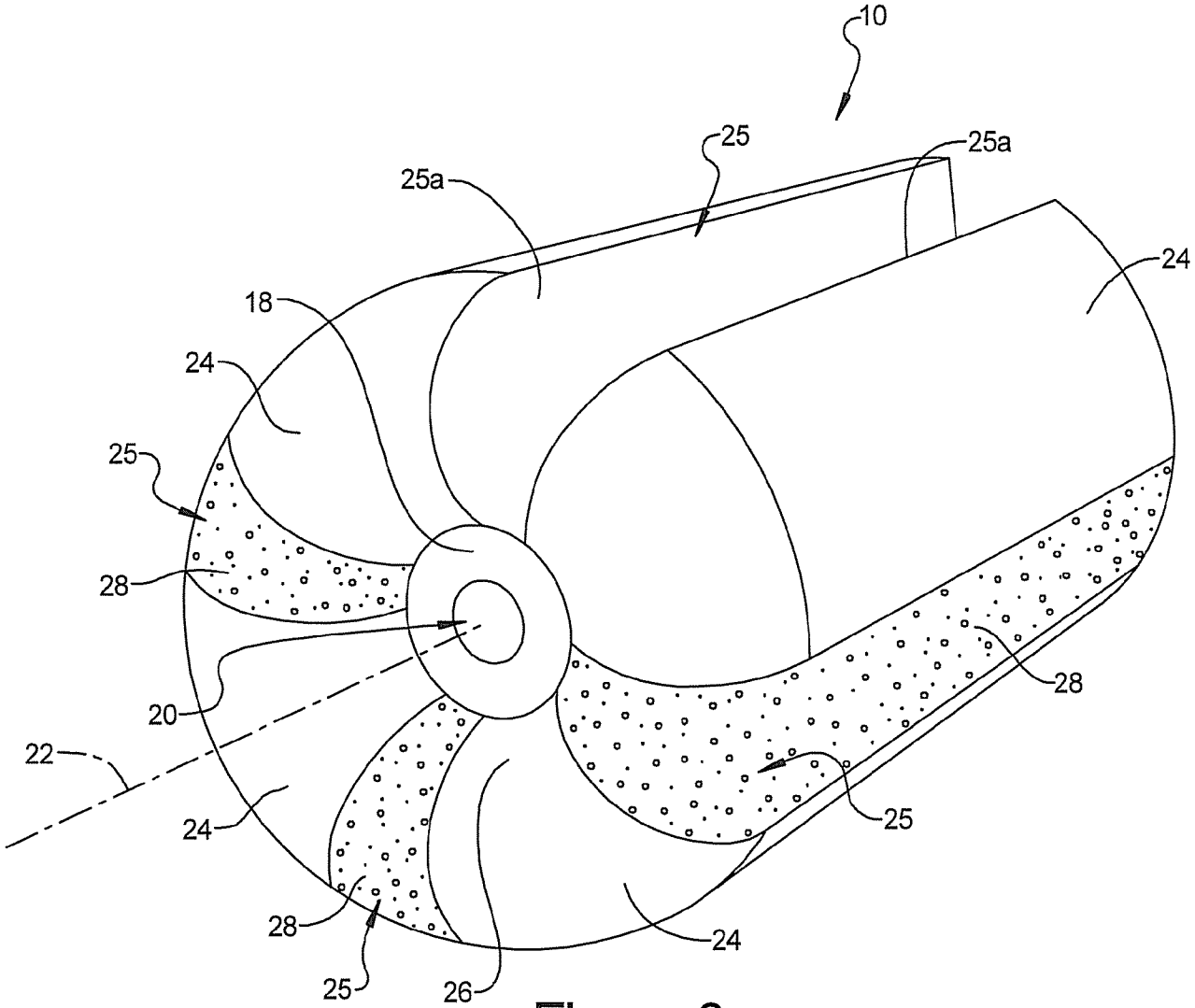
FIG. 3 is a perspective view of the suppressor of FIG. 2 but with the thermally conductive material removed from one of the air gap sections to expose the wall structure of one of the axial flow segments.
Figure 4:
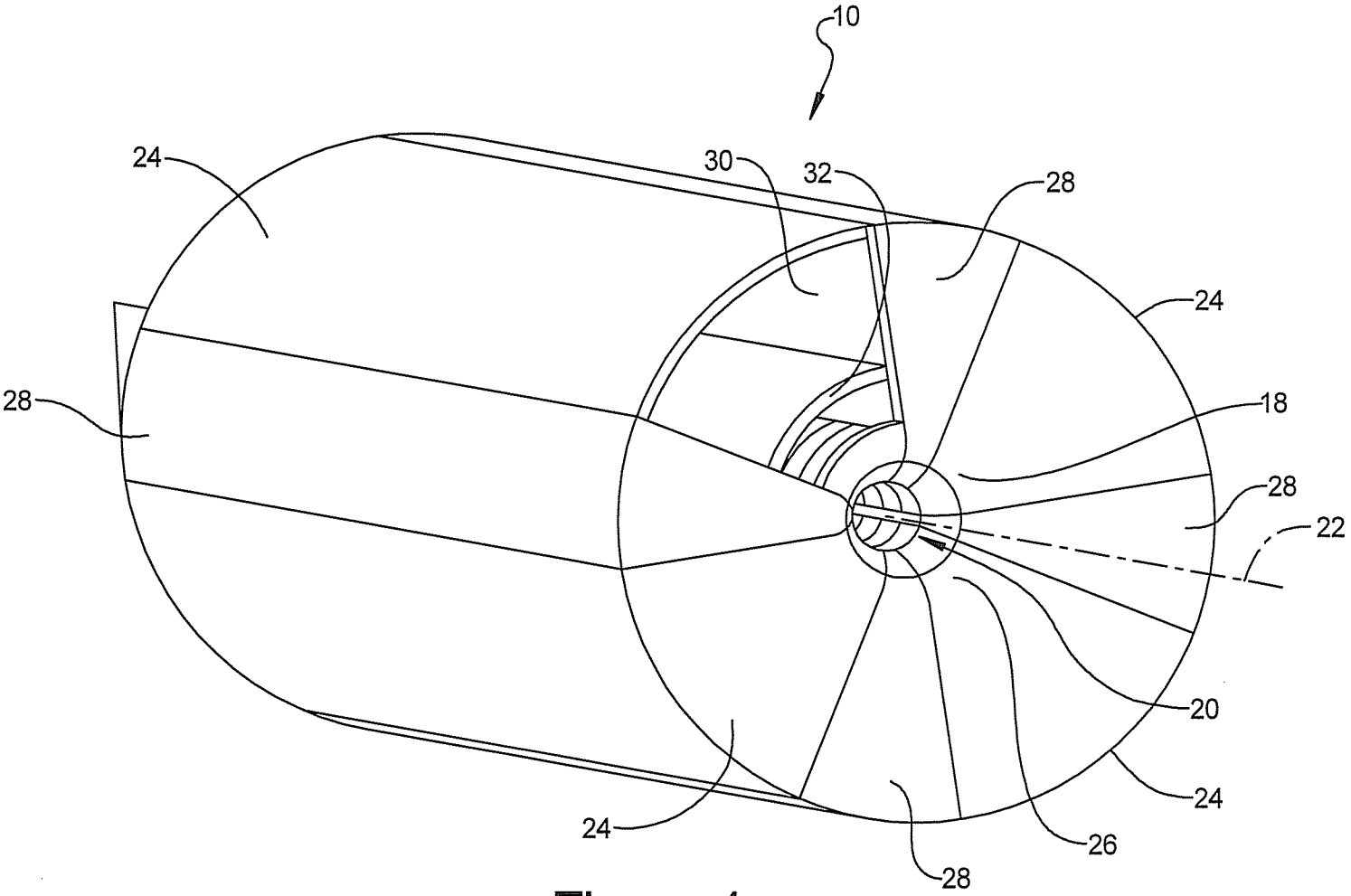
FIG. 4 is a perspective end view of the suppressor of FIG. 2 with a portion of a front face of the suppressor removed to illustrate a portion of the flow path within one of the axial flow segments.

The suppressor 10 is shown in greater detail in FIGS. 3 and 4. The suppressor 10 has an inner portion 18 with a bore 20 extending through its axial center 22. The bore 20 is coaxially aligned with a bore axis of the barrel 16 when the suppressor 10 is attached to the barrel. The suppressor 10 may have a plurality of axial flow segments 24 that each form an axially extending flow path or flow channel, and which are separated by air gap sections 25. Each of the axial flow segments 24 is also in flow communication with the bore 20 so that expanding propellant gasses discharged from the barrel 16, which enter the suppressor 10, may flow through each of the axial flow segments 24 before being discharged from the bore 20. The air gap sections 25 may be filled with a thermally conductive material 28. A front face 26 of the suppressor 10 may have a curved configuration to assist in directing the flow of the expanding propellant gasses back toward and into the bore 20 just prior to discharge of the gasses from the suppressor.

FIG. 3 illustrates the suppressor 10 with one of the air gap sections 25 having its thermally conductive material 28 removed. Each one of the air gap sections 25 is formed between radially extending wall portions 25*a* that extend from the inner portion 18 of the suppressor. Thus, wall portions 25*a* effectively help to form the axial flow segments 24 and help contain the flow of the expanding propellant gasses within each of the axial flow segments 24. This configuration results in the axial flow segments 24 extending radially outwardly from the main body portion 18, with one of the air gap sections 25 positioned between each adjacent pair of axial flow segments 24. In this configuration each of the axial flow segments 24 has a pie shape when looking at the suppressor 10 in cross section from one end thereof. However, it will be understood that the axial flow segments 24 could be formed to have other shapes besides a pie shape. For example, the air gap sections 25 could be formed so that the axial flow segments 24 each have a rectangular cross sectional configuration. When using a pie shape for each of the axial flow segments 24, the overall cross sectional shape of the suppressor 10, minus the thermally conductive portions 28, appears similar to a cloverleaf.

The axial flow segments 24 have been illustrated as extending completely along the entire axial length of the suppressor 10. However, it is possible that in some applications the axial flow segments 24 may be shortened to a length which is less than the overall length of the suppressor 10. It is anticipated that to achieve optimal thermal transfer of heat out from the inner portion 18, and also for maintaining the temperature distribution throughout the suppressor 10 more homogeneous, in most instances the axial lengths of the axial flow segments 24 will need to be maximized. This means that in most instances it will be preferable to construct the axial flow segments 24 so that they extend along the full axial length of the inner portion 18 of the suppressor 10. The front face 26, with its curvature, provides a gradual, curving, internal flow path for the expanding propellant gasses flowing through the axial flow segments 24, and thus helps to prevent particulates in the gasses from accumulating in interior areas of the suppressor 10.

Referring further to FIG. 3, in one embodiment the thermally conductive material 28 used is thermally conductive foam. In one example embodiment the thermally conductive foam comprises high thermal conductivity carbon foam which is used to fill each of the air gap sections 25. One type of high thermal conductivity carbon foam which is especially well suited for use with the suppressor 10 has been developed by the Oak Ridge National Laboratory (ORNL) and has a relatively low density between about 0.2-0.6 gram/cc, a thermal conductivity between about 40-180 W/m K (Watts per meter Kelvin), and reasonable strength. This particular foam is commercially available under the name "K-foam". Studies of the thermal conductivity characteristics of carbon foam-based material such as the carbon foam developed by ORNL (i.e., K-foam) described above have shown that such materials can have overall heat transfer coefficients of up to two orders of magnitude greater than those of other conventional heat sink materials. Because of its low density, its high thermal conductivity, its relatively high surface area and its open celled structure, K-foam forms an especially attractive material for thermal management applications, such as in use with the suppressor 10. However, it will be appreciated that the suppressor 10 is not limited to use with any one specific thermal management material, and other suitable thermal management materials could be employed in the construction of the suppressor 10 besides the carbon foam material described above. It is also possible that no thermal management material at all may be used to fill the air gap sections 25. In other words, it is possible that the air gap sections 25 could just be closed off with an outermost wall portion, and the walls 25*a* used to radially draw heat away from near the bore, and dissipate the heat to an ambient environment, without the use of a separate thermal management material. In such an embodiment, each of the air gap sections 25 would appear the same as the air gap section 25 at the 12 o'clock position on the suppressor 10 in FIG. 3.

FIG. 4 also illustrates a portion of an interior flow area 30 of one of the axial flow segments 24. In this example the construction of the interior flow areas of all the axial flow segments 24 is the same, although they need not be the same. It will be apparent that the sections of thermally conductive material 28 do not interfere with axial or radial flow of the expanding propellant gasses as the gasses make their way through the interior area of each of the axial flow segments 24. In this embodiment the thermally conductive material extends down to the inner portion 18 of the suppressor 10 which helps significantly in dissipating heat that is built up deep within the suppressor 10, and also helps to maintain a homogeneous temperature distribution throughout the entire cross section of the suppressor 10. In this regard it will be appreciated that a condition where significant temperature gradients are created throughout different portions of the suppressor 10 would be detrimental to the longevity of the suppressor. Accordingly, the use of the air gap sections 25 filled with the thermally conductive material 28 is expected to significantly enhance the longevity of the suppressor 10.

The sections of thermally conductive material 28 could be retained in the air gap sections 25 in different ways. One way involves installing a circumferential metallic sleeve over the entire outer axial length of the suppressor 10 after the thermally conductive material 28 portions are positioned in the air gap sections 25 during assembly of the suppressor 10. Another arrangement could involve manufacturing the suppressor 10 such that an outermost wall portion extends over each of the air gap sections 25 so that the air gap sections each form a hollow volume. The thermally conductive material 28 (e.g., carbon foam) could then be injected, if it is able to be provided while in a flowable state, through a series of small openings in the outermost wall portion that provide access to the volumes forming the air gap sections 25. Alternatively the sections of the thermally conductive material 28 could be pre-formed to the desired shape and dimensions and then inserted into each of the air gap sections 25 from one open end of the suppressor 10. After each of the air gap sections 25 is filled with the thermal management material, the openings (or an open end portion) could be sealed to retain the thermally conductive material therein. In some instances, sealing of the small openings may not be needed.

It will also be appreciated that while the sections of the thermally conductive material 28 have been shown in FIG. 3 as extending down to the inner portion 18 of the suppressor 10, that the thermally conductive material sections need not extend all the way down to the inner portion 18. For example, in FIG. 4 it can be seen that an intermediate circumferential wall portion 32 may exist in one of the axial flow segments 24. Such a wall portion could just as easily be incorporated within each of the air gaps 25 to limit the radial dimension of the thermally conductive material 28 in each air gap 25.

It will be appreciated that the dimensions of the air gap sections 25, and thus by consequence the dimensions of the axial flow segments 24, could be varied to tailor the suppressor 10 to specific weapons. For example, while four axial flow segments 24 have been illustrated for the suppressor 10, the suppressor could be formed with a greater or lesser plurality of axial flow segments 24. Also, the angular extent of the air gap sections 25 may be modified to help create a greater or lesser volume for each of the axial flow segments 24. Still further, the air gap sections 25 need not all be the same in angular extent; some could have a larger angular extent than other ones of the air gap sections 25, which would create axial flow segments 24 having different angular extents (and different volumes) as well.

It is expected that firearms having different firing rates, or possibly firing different calibers of ammunition, may necessitate modifications to the dimensions of the suppressor 10, and therefore the suppressor 10 dimensions provided herein should be understood as being subject to modification. However, the suppressor 10 may have a typical length of between about 5.0-10.0 inches, and in one example around 7.2 inches in overall length. The suppressor 10 may have an overall outer diameter of typically between about 1.0-3.0 inches, and in one example about 2.1 inches. But as noted above, each of these dimensional ranges may be varied as needed to tailor the suppressor 10 for use with specific weapons and/or cartridge sizes.

The suppressor 10 is especially well suited for use with weapons that are designed for firing rapid bursts of ammunition, and especially modern day machine guns that are capable of firing bursts at rates of hundreds of rounds per minute. The suppressor 10 is able to dissipate the high degree of heat that is deposited deep within the suppressor from such rapid rates of fire without the need to increase the dwell time of the expanding propellant gasses within the suppressor. This also eliminates the concern that arises with longer dwell times, which could generate too much back pressure into the barrel of the weapon, which could in turn adversely affect the cycling of the bolt of the weapon 12.

Figure 5:
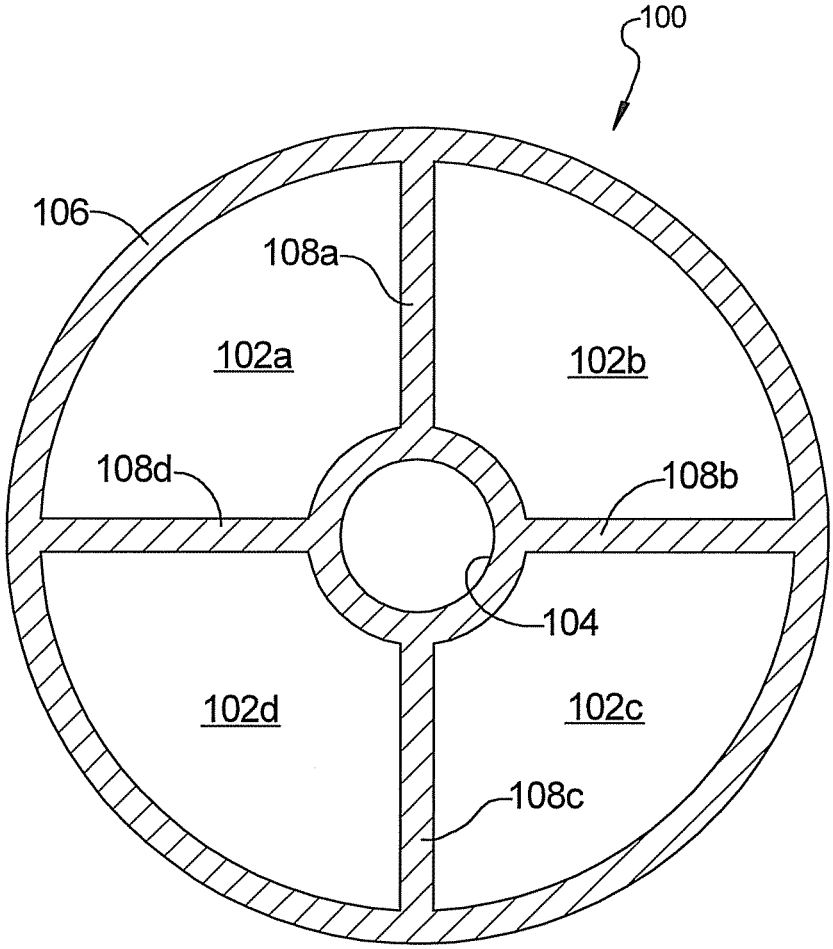
FIG. 5 is a simplified cross sectional end view of another embodiment of a suppressor in accordance with the present disclosure, looking into the suppressor from a discharge end of the suppressor.

Referring to FIG. 5 another suppressor 100 is shown in accordance with another embodiment of the present disclosure. The suppressor 100 includes four distinct, independent axial flow segments 102*a*, 102*b*, 102*c* and 102*d* that are arranged circumferentially around a bore 104. An outermost wall portion 106 and radially extending wall portions 108*a*-108*d* help to form the axial flow segments 102*a*-102*d*. With the suppressor 100 it will be appreciated that no air gap sections are provided between adjacent ones of the axial flow segments 102*a*-102*d*. Each of the axial flow segments 102*a*-102*d* may include any desired configuration of flow-delaying structure (i.e., non-linear or serpentine flow paths, baffles, chambers, etc.), and thus is not limited to use with any specific for flow-modifying or flow-delaying internal structure. Each of the axial flow segments 102*a*-102*d* is also in flow communication with bore 104 through various openings (not shown) in the bore so that the hot, expanding propellant gasses entering the bore 104 from the barrel 16 are channeled into the axial flow segments. Likewise, the axial flow segments 102*a*-102*d* are also in communication with the bore 104 near a discharge end of the suppressor 100 so that the hot expanding propellant gasses are able to be discharged from the suppressor 100 out through the bore 104.

It will be appreciated that the precise configuration of the openings in the bore that communicate with the axial flow segments 102*a*-102*d* will depend at least in part on the flow-delaying structure and the configuration of the flow paths incorporated in each of the axial flow segments 102*a*-102*d*. And while the axial flow segments 102*a*-102*d* are shown to be identical in dimensions, it will be appreciated that they need not be identical. The radially extending wall portions 108*a*-108*d* could be arranged such that the axial flow segments 102*a*-102*d* have different cross sectional areas. Still further, while four radially extending wall portions 108*a*-108*d* are shown, a greater or lesser plurality of wall portions could be used to form a greater or lesser plurality of axial flow segments.

Each of the radially extending wall portions 108*a*-108*d* forms a common wall for adjacent pairs of the axial flow segments 102*a*-102*d* and helps dissipate heat that is deposited deep within the suppressor 100 during firing of the weapon 12. This helps to reduce the temperature of the hot expanding propellant gasses as they travel through the suppressor 100 before being discharged from the suppressor, which in turn helps to reduce the possibility of muzzle flash from the discharge end of the suppressor. The suppressor 100 also helps to maintain a homogeneous temperature throughout the interior areas of the suppressor 100 and thus is expected to increase the longevity of the suppressor.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A suppressor for a weapon, where the weapon has a barrel, the suppressor comprising:

an inner portion having a bore extending therethrough, the inner portion adapted to be secured to a distal end of the barrel;

a plurality of axial flow segments arranged radially around the inner portion, and being in flow communication with the bore and forming axially extending flow paths generally parallel to the bore for expanding propellant gasses discharged from the barrel to flow through, the axial flow segments further having radially extending wall portions which enhance a dissipation of heat deposited in the suppressor during firing of the weapon; and a thermally conductive air gap section disposed adjacent to at least one of the axial flow segments, the thermally conductive air gap section being formed at least in part by a pair of the radially extending wall portions to define a region that is not in fluid flow communication with the bore and through which no flow of the expanding propellant gasses occurs.

2. The suppressor of claim 1, further comprising a plurality of thermally conductive air gap sections, and wherein certain ones of the thermally conductive air gap sections are disposed in alternating fashion between adjacent ones of the axial flow segments.

3. The suppressor of claim 1, wherein the thermally conductive air gap section is at least substantially filled with a thermally conductive material to further facilitate dissipation of the heat deposited within the suppressor during firing of the weapon.

4. The suppressor of claim 3, wherein the thermally conductive material comprises thermally conductive foam.

5. The suppressor of claim 4, wherein the thermally conductive foam comprises thermally conductive carbon foam.

6. The suppressor of claim 4, wherein the thermally conductive foam has a density of between about 0.2-0.6 gram per cubic centimeter.

7. The suppressor of claim 4, wherein the thermally conductive foam has a thermal conductivity of between about 40-180 Watts per meter Kelvin.

8. The suppressor of claim 3, wherein the thermally conductive material within the air gap section extends radially inward to the inner portion of the suppressor.

9. The suppressor of claim 1, wherein at least one of the radially extending wall portions forms a common wall for two adjacent ones of the axial flow segments.

10. The suppressor of claim 1, wherein the radially extending wall portions extend into contact with the inner portion of the suppressor.

11. A suppressor for a weapon, where the weapon has a barrel, the suppressor comprising:

an inner portion having a bore extending therethrough, the inner portion adapted to be secured to a distal end of the barrel;

a plurality of axial flow segments projecting radially around the inner portion and, formed in part by radially extending wall portions, the axial flow segments extending generally parallel to the bore and forming independent axial flow paths which are in flow communication with the bore and arranged circumferentially around the bore, and which expand propellant gasses discharged from the barrel; and a thermally conductive air gap section disposed adjacent to at least one of the axial flow segments, the thermally conductive air gap section being formed at least in part by a pair of the radially extending wall portions to define a region that is not in fluid flow communication with the bore and through which no flow of the expanding propellant gasses occurs.

12. The suppressor of claim 11, wherein each of the air gap section is at least substantially filled with a thermally conductive material to facilitate thermal dissipation of heat generated within the suppressor during firing of the weapon.

13. The suppressor of claim 12, wherein the thermally conductive material comprises carbon foam.

14. The suppressor of claim 13, wherein the carbon foam has a density between about 0.2-0.6 gram per cubic centimeter.

15. The suppressor of claim 13, wherein the carbon foam has a thermal conductivity between about 40-180 Watts per meter Kelvin.

16. The suppressor of claim 12, wherein the air gap section is fully filled with the thermally conductive material, and wherein the thermally conductive material comprises thermally conductive carbon foam having at least one of:

a density between about 0.2-0.6 gram per cubic centimeter; and a thermal conductivity between about 40-180 Watts per meter Kelvin.

17. The suppressor of claim 11, wherein the radially extending wall portions extend into contact with the inner portion of the suppressor.

18. A method for suppressing noise and/or flash emanating from a barrel of a weapon when a bullet is fired from the barrel of the weapon, the method comprising:

securing an inner portion of a suppressor to a distal end of the barrel to receive the bullet and expanding propellant gasses discharged from the distal end of the barrel when the weapon is fired;

using a bore within the inner portion of the suppressor to receive and channel the expanding propellant gasses through the suppressor;

using a plurality of independent axial flow segments of the suppressor, each said axial flow segment being formed by adjacent pairs of radially extending wall portions, and being arranged radially around the inner portion and extending generally parallel to the bore and being in flow communication with the bore, to receive portions of the expanding propellant gasses as the expanding propellant gasses flow through the bore, and to delay the exit of the portions of the expanding propellant flow from the suppressor; and using a thermally conductive air gap section disposed adjacent to at least one of the axial flow segments to conduct heat away from the bore, the thermally conductive air gap section being formed at least in part by a pair of the radially extending wall portions to define a region that is not in fluid flow communication with the bore and through which no flow of the expanding propellant gasses occurs.

19. The method of claim 18, further comprising using a plurality of the thermally conductive air gap sections, and arranging certain ones of the thermally conductive air gap sections between pairs of the axial flow segments in alternating fashion.

20. The method of claim 18, further comprising using a thermally conductive material to at least substantially fill the air gap section to further help dissipate the heat deposited in the suppressor.

* * * * *